United States Patent [19]

Watanabe

[11] Patent Number: 4,935,670

[45] Date of Patent: Jun. 19, 1990

[54] IMAGE DISPLAY DEVICE

[75] Inventor: Hiroshi Watanabe, Mobara, Japan

[73] Assignee: Futaba Denshi Kogyo Kabushiki Kaisha, Mobara, Japan

[21] Appl. No.: 164,910

[22] Filed: Mar. 7, 1988

[30] Foreign Application Priority Data

Mar. 11, 1987 [JP] Japan ..... 62-53963

[51] Int. Cl.[5] ..... G09G 3/10; G09G 3/4; G09G 3/34; G09G 3/26

[52] U.S. Cl. ..... 315/169.1; 315/169.4; 340/752; 340/783; 340/768; 340/781; 358/56; 358/59; 358/230

[58] Field of Search ..... 315/169.1, 169.4; 340/752, 783, 781, 768; 358/230, 56, 59

[56] References Cited

U.S. PATENT DOCUMENTS 3,023,137 2/1962 Colborne et al. ..... 315/169.1
3,566,187 2/1971 DuBois Jr. ..... 315/169.1
4,218,636 8/1920 Miyazawa ..... 340/781
4,459,514 7/1984 Morimoto et al. ..... 340/781
4,654,649 3/1987 Kojima et al. ..... 340/781

FOREIGN PATENT DOCUMENTS 58-59542 8/1983 Japan .
2189117 10/1987 United Kingdom ..... 340/781

*Primary Examiner*—Eugene R. Laroche
*Assistant Examiner*—Michael B. Shingleton
*Attorney, Agent, or Firm*—Oblon, Spivak, McClelland, Maier & Neustadt

[57] ABSTRACT

An image display device capable of causing an interval between picture cells to be significantly decreased using control electrode means of a simple structure, to thereby provide a displayed image with high resolution. In the device, two control electrode groups are arranged in directions across each other, wherein the respective pairs of control electrodes in one of the control electrode groups are scanned in turn. The respective adjacent three or more control electrodes of the other groups are divided into sets, in which the respective pairs of the control electrodes are driven in turn in synchronism with the scanning.

12 Claims, 10 Drawing Sheets

IMAGE DISPLAY DEVICE

BACKGROUND OF THE INVENTION

1. Field of the Invention

This invention relates to an image display device to which a principle of a fluorescent display device is applied, and more particularly to an image display device including first control electrode means comprising a plurality of control electrodes arranged in parallel to one another and second control electrode means comprising a plurality of control electrodes arranged in parallel to one another and in a direction across the first control electrode means wherein each pair of the control electrode of the first control electrode means and each pair of the control electrodes of the second control electrode means are selectively simultaneously driven for display.

2. Description of the Prior Art

A fluorescent display device generally includes a phosphordeposited anode acting as a luminous section, a cathode acting as an electron emitting source, a control electrode for accelerating and controlling electrons emitted from the cathodes, and a casing which receives the above-described electrodes therein and evacuated to high vacuum. A conventional image display device which utilizes a principle of the fluorescent display device constructed as described above and is adapted to carry out matrix display is classified into two types.

One of the two types is constructed in such a manner that a plurality of strip-like anodes arranged in parallel to one another and a plurality of strip-like mesh-like control electrodes arranged in parallel to one another above the strip-like anodes and in a direction across the anodes cooperate together to constitute a matrix, and a scan drive signal is supplied to the mesh-like control electrodes and a display input signal is supplied to the strip-like anodes in synchronism with supply of the scan drive signal, resulting in luminous display.

The other type image display device is constructed as disclosed in Japanese Patent Application Laying-Open Publication No. 59542/1983. More specifically, a plurality of linear control electrodes are arranged in parallel to one another in each of X and Y directions. Positive voltage is constantly applied to phosphor-deposited anodes, and a scan drive signal is supplied to the respective pairs of adjacent control electrodes in the X direction in order and a display drive signal is supplied to the respective pairs of adjacent control electrodes in the Y direction. This causes any desired areas on the anode to be selected as picture cells, resulting in luminous display.

In the former image display device, a decrease in an interval between adjacent picture cells which is necessary to cause the device to exhibit luminous display of high resolution requires to reduce an interval between adjacent mesh-like control electrodes. However, this renders manufacturing of the device highly troublesome and difficult. Also, the device fails to form a distinct image because electrons which leak through a gap between the mesh-like control electrodes impinge on a phosphor layer which is not desired to exhibit luminous display to lead to leakage luminance. In order to avoid such a problem, it is proposed to cover the gap with an insulating material. Unfortunately, this renders manufacturing of the device further troublesome.

The latter image display device is proposed in order to solve the above-noted problems of the former device.

More particularly, a decrease in an interval between picture cells is accomplished by arranging a plurality of the linear control electrodes in parallel to one another in each of the X and Y directions, to thereby prevent the above-noted leakage luminance and facilitate manufacturing of the device. However, it was found that the image display device exhibits an important problem in selection of the picture cells at the time of driving.

The problem will be more detailedly described with reference to FIG. 13 which schematically shows a structure of the image display device.

A plurality of the linear control electrodes arranged in parallel to one another in the X direction or a lateral direction in FIG. 13 are connected to a scan drive circuit connected to a timing control circuit. A plurality of the linear control electrodes arranged in parallel to one another in the Y direction or a vertical direction in FIG. 13 are connected to a display drive circuit connected to the timing control circuit. To the respective pairs of each adjacent two such linear control electrodes in the X direction or a horizontal direction in FIG. 13 is applied the same positive voltage from the scan drive circuit in turn. In synchronism with the application, the display drive circuit supplies a signal corresponding to a display input signal to the linear control electrodes in the Y direction. For example, when it is desired to cause picture cells A, B and D to emit light, it is required that the scan drive circuit simultaneously drives linear control electrodes 1 to 6 at the same positive voltage while the scan drive circuit selectively drives linear control electrodes 7 and 8 at the same positive voltage. However, at this time, linear control electrodes on both sides of a picture cell C which is not desired to emit light are concurrently kept at positive voltage, resulting in the picture cell C undesirably carrying out light emission.

SUMMARY OF THE INVENTION

The present invention has been made in view of the foregoing disadvantages of the prior art.

Accordingly, it is an object of the present invention to provide an image display device which is capable of preventing leakage luminance.

It is another object of the present invention to provide an image display device which is capable of significantly decreasing an interval between picture cells to provide a displayed image with high resolution.

It is a further object of the present invention to provide an image display device which is capable of accomplishing the above-noted objects with a simple structure.

In accordance with the present invention, an image display device is provided. The device includes an anode comprising a phosphor layer and a conductive layer deposited in a desired order on a substrate. Above the anode is provided first control electrode means which comprises a plurality of control electrodes arranged in parallel with one another above the anode. Above the first control electrode means is provided second control electrode means which comprises a plurality of control electrodes arranged in parallel with one another above the first control electrode means and in a direction across the first control electrode means. The device also includes an electron source arranged above the second control electrode means for generating electrons therefrom. The so-arranged anode, first and second control electrode means, and electron source are received in an envelope formed by a combination of a casing with the substrate, which is then evacuated to high vacuum. The device further includes positive voltage supply means for supplying positive voltage to the conductive layer of the anode and a scan circuit for scanning the respective pairs of the control electrodes in one of the first and second control electrode means in turn. The respective adjacent three or more control electrodes in the other of the first and second control electrode means are divided into sets, and the respective pairs of the control electrodes in the respective sets are driven in turn by display drive means.

In the present invention constructed as described above, for example, the respective pairs of the control electrodes of the first control electrode means are scanned in turn and the respective adjacent three or more control electrodes of the second control electrode means are divided into sets. The respective pairs of the control electrodes in the respective sets are driven in turn by the display drive means in synchronism with the scanning. Such construction permits at least one control electrode which is not used for display drive to be interposed between each adjacent two sets, to thereby prevent an anode which is not desired to exhibit luminous display from emitting light.

BRIEF DESCRIPTION OF THE DRAWINGS

These and other objects and many of the attendant advantages of the invention will be readily appreciated as the same becomes better understood by reference to the following detailed description when considered in connection with the accompanying drawings, wherein.

DETAILED DESCRIPTION OF THE PREFERRED EMBODIMENTS

Now, an image display device according to the present invention will be described hereinafter with reference to the accompanying drawings.

The following description will be made mainly in connection with electrodes arranged in an envelope and circuits for driving the electrodes, as well as driving of the electrodes.

Figure 1:
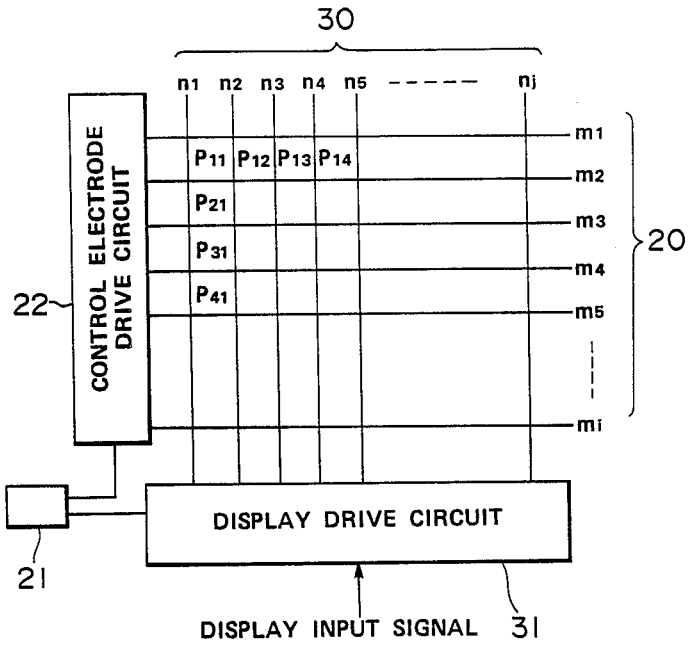
FIG. 1 is a schematic view showing an embodiment of an image display device according to the present invention.
Figure 2A:
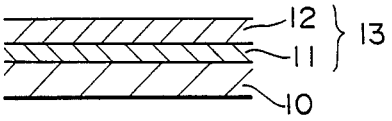
FIGS. 2(*a*) and 2(*b*) each are a vertical sectional view showing a structure of an anode in the embodiment of FIG. 1.
Figure 2B:
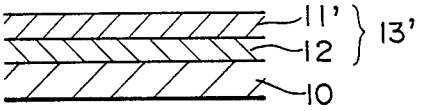

FIGS. 1 to 4 shows an embodiment of an image display device according to the present invention. An image display device of the illustrated embodiment includes an anode comprising a conductive layer arranged on a substrate constituting a part of an envelope and a phosphor layer deposited on the conductive layer, although it is not shown in FIG. 1. Such an anode may be constructed as shown in FIG. 2(*a*), in which an anode generally designated by reference numeral 13 comprises a conductive layer 11 depositedly formed on a substrate 10 and a phosphor layer 12 deposited on the conductor layer 11. Alternatively, it may be constructed as shown in FIG. 2(*b*), wherein an anode 13' comprises a phosphor layer 12 deposited on a substrate 10 and a metal backing 11' which is arranged to cover the phosphor layer 12 and serves as a conductor layer. The so-constructed anode may be formed all over the substrate or in a strip-like manner on the substrate. Alternatively, the phosphor layer may be deposited on the conductive layer in a dot-like or strip-like manner to prevent bleeding of a luminous center. The conductive layer of the anode is electrically connected to positive voltage supply means.

The image display device of the first embodiment of FIG. 1 schematically showing electrodes, driving circuit and the like in the device includes first control electrode means 20 arranged above the anode constructed as described above but not shown in FIG. 1. The first control electrode means 20 comprises a plurality of linear control electrodes $m_l$, –, $m_i$ arranged in parallel with one another. The linear control electrodes m are connected to a control electrode drive circuit 22 connected to a timing control circuit 21 and serving as a scan circuit. The control electrode drive circuit 22 is adapted to scan the respective pairs of adjacent two linear control electrodes m in turn while shifting. The image display device also includes second control electrode means 30 arranged above the first control electrode means 20 and in a direction perpendicular thereto. The second control electrode means 30 comprises a plurality of linear control electrodes $n_l$, –, $n_j$ arranged in parallel with one another and in a direction perpendicular to the linear control electrodes m. The linear control electrodes m and n thus arranged in directions perpendicular to each other longitudinally and laterally divide the phosphor layer into a plurality of regions, which constitute picture cells each forming a display unit for image display. The linear control electrodes n are connected to a display drive circuit 31 connected to the timing control circuit 21 and acting as display drive means. The respective adjacent three linear control electrodes n of the second control electrode means 30 are divided into sets, and the display drive circuit 31 drives the respective pairs of positionally corresponding control electrodes n in the respective sets in turn while shifting.

The manner of operation of the image display device of the first embodiment constructed as described above will be described hereinafter.

Figure 3:
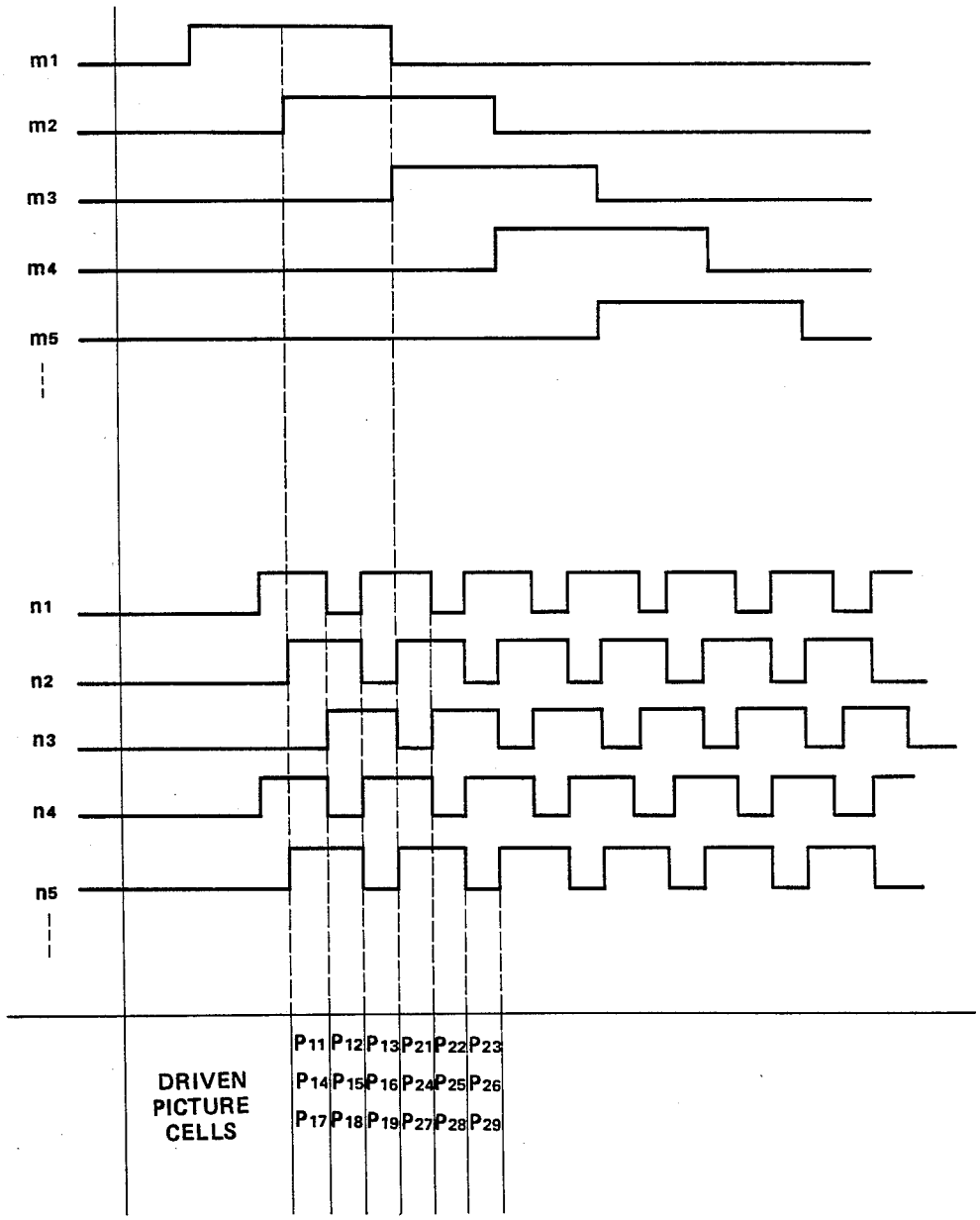
FIG. 3 is a timing chart showing an example of timing of drive in the embodiment of FIG. 1.
Figure 4:
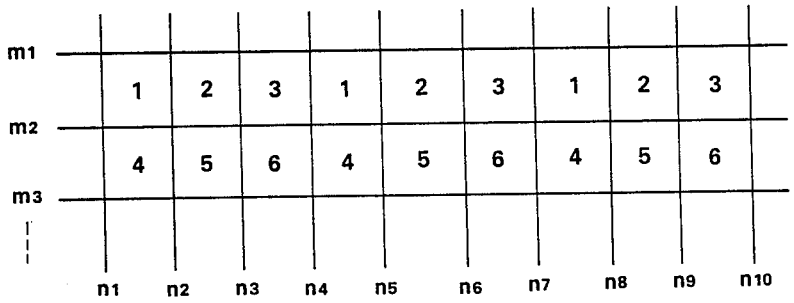
FIG. 4 is a view showing an order in which picture cells are driven in the embodiment of FIG. 1.

First, positive voltage of a predetermined level is applied from the positive voltage supply means to the conductive layer of the anode and a filamentary cathode (not shown) acting as an electron source is electrically heated. Then, as shown in FIG. 3, the respective pairs of adjacent linear control electrodes m in the first control electrode means 20 are scanned in turn while being shifted. Also, in synchronism with the scanning, the display drive circuit 31 supplies a drive signal corresponding to a display input signal to the second control electrode means 30. For example, when causing all the picture cells to omit light as shown in FIG. 3, the respective pairs of linear control electrodes n in the respective sets of three such linear control electrodes are driven in turn. Accordingly, a plurality of picture cells P in row surrounded by or interposed between each pair of the linear control electrodes m being scanned are divided into sets of three corresponding to the sets of the linear control electrodes n, and each set of the control electrodes n concurrently drive positionally corresponding picture cells. FIG. 4 numerically indicates an order of such drive of the picture cells. Picture cells in a row surrounded by a pair of linear control electrodes m being scanned, for example, electrodes $m_1$ and $m_2$ are divided into sets of three by one set of three linear control electrodes, for example, indicated by $n_1$, $n_2$ and $n_3$, and the positionally corresponding picture cells in the respective sets, for example, the picture cells $P_{11}$, $P_{14}$, —indicated at an initial numeral of 1 are simultaneously driven.

As described above, in the illustrated embodiment, the linear control electrodes n of the second control electrode means 30 are divided into sets of three, and the respective pairs of positionally corresponding linear control electrodes in the respective sets are driven in turn in synchronism with scanning of the first control electrode means 20. Such construction permits driving of each of the picture cells to be controlled as desired, to thereby prevent the picture cells which are not desired to carry out luminous display from emitting light. Also, the illustrated embodiment causes an interval between the picture cells to be reduced with a simple structure, so that display may be provided with high resolution.

Also, in the illustrated embodiment, the linear control electrodes n are divided into sets of three. However, a change of arrangement of a data can be often simply carried out when they are divided into sets of four depending on the number of bits of an IC used for the display drive circuit 31. The number of sets into which the control electrodes n divided may be suitably selected depending on a type of an IC used, driving conditions and the like. In the illustrated embodiment, division of the control electrodes n into sets of three or more can be realized.

Figure 5:
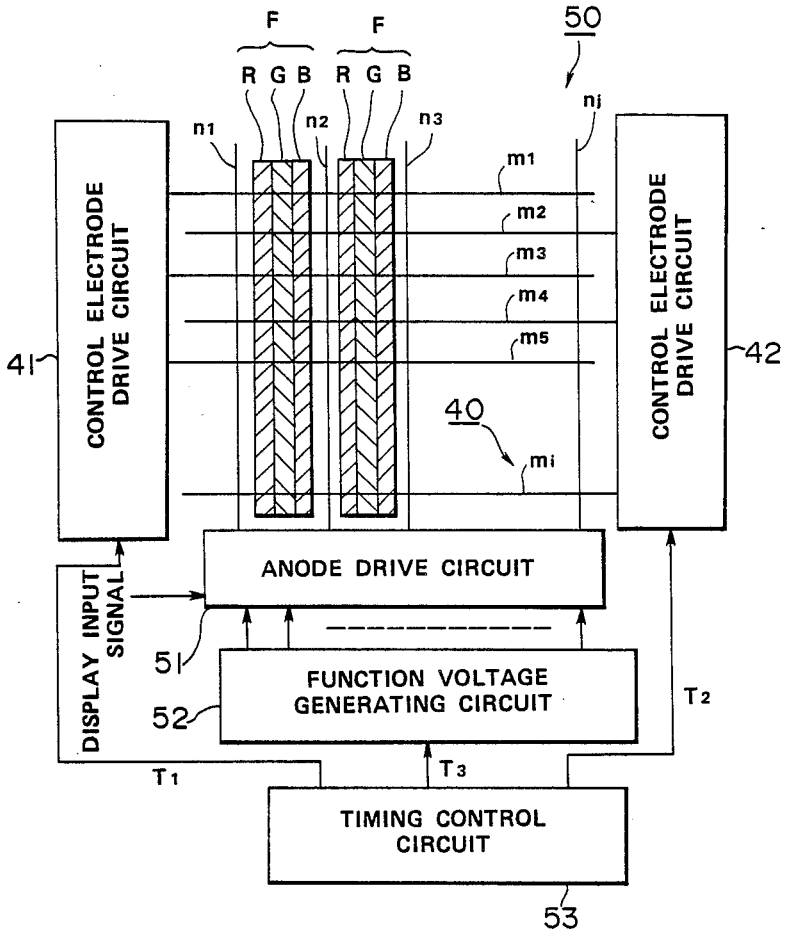
FIG. 5 is a schematic view showing another embodiment of an image display device according to the present invention.
Figure 6:
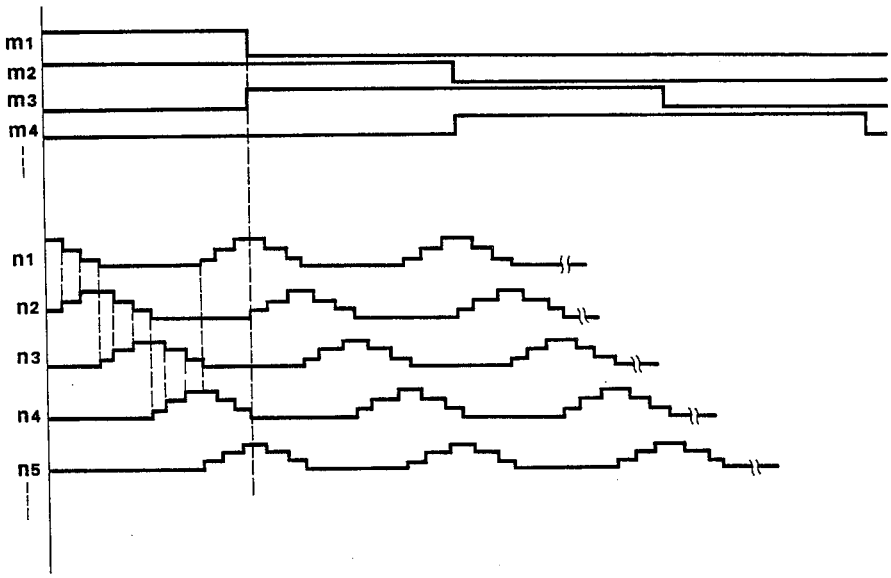
FIG. 6 is a timing chart showing an example of timing of drive in the embodiment of FIG. 5.
Figure 7:
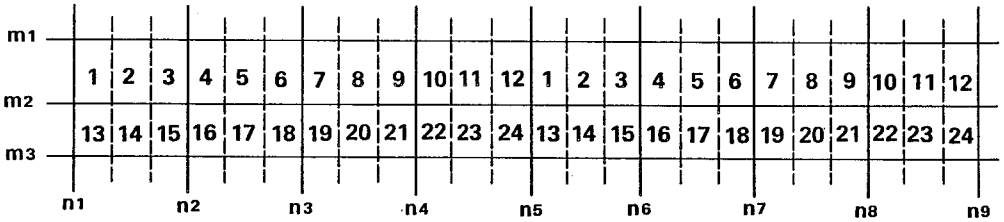
FIG. 7 is a view showing an order in which picture cells are driven in the embodiment of FIG. 5.

FIGS. 5 to 7 show another embodiment of an image display device according to the present invention.

In an image display device of the embodiment, a transparent conductive layer is deposited all over an upper surface of a substrate, and a plurality of strip-like phosphor layers F are deposited in parallel with one another on the transparent conductive layer. The phosphor layers F, as shown in FIG. 5, each comprises three strip-like phosphor layer elements R, G and B exhibiting red, green and blue luminous colors, respectively. Above the phosphor layers F is provided a second control electrode means 50 comprising a plurality of linear control electrodes $n_1$, –, $n_j$ arranged in parallel with one another and in a direction in parallel with the phosphor layers F in such a manner that each adjacent two control electrodes interpose each of the phosphor layers F therebetween. The second control electrodes 50 are connected to an anode drive circuit 51 serving as display drive means to which a display input signal is supplied, which is then connected to a function voltage generating circuit 52 which generates a staircase-like cycle signal for controlling the linear control electrodes n. The function voltage generating circuit 52 is connected to a timing control circuit 53 which generates a timing pulse. Above or below the second control electrode means 50 is arranged a first control electrode 40, which comprises a plurality of linear control electrodes $m_l$, –, $m_i$ arranged in parallel with one another and in a direction perpendicular to the linear control electrodes n of the second control electrode means 50. The linear control electrodes m are alternately connected to control electrode drive circuits 41 and 42 each comprising a shift resistor and serving as a scan circuit. The control electrode drive circuits 41 and 42 are connected to the timing control circuit 53.

The manner of operation of the embodiment of FIG. 5 constructed as described above will be described hereinafter in connection with driving of the first and second control electrode means 40 and 50 with reference to FIGS. 5 to 7.

FIG. 6 is a timing chart for driving all picture cells for luminance. As shown in FIG. 6, the control electrode drive circuits 41 and 42 scan the respective pairs of adjacent two linear control electrodes $m_1$, –, $m_i$ of the first control electrode means 40 in turn while shifting, in response to timing pulses $T_1$ and $T_2$ from the timing control circuit 53. The function voltage generating circuit 52 receives a timing pulse $T_3$ from the timing control circuit 53 to generate a staircase-like synchronizing signal for controlling the linear control electrodes $n_1$, –, $n_j$ of the second control electrode means 50. The anode drive circuit 51 selectively supplies an output signal generated from the function voltage generating circuit 52 to the linear control electrodes n in response to a display input signal. When the display input signal is a signal which causes all picture cells on one line to emit light, such a signal as shown in FIG. 6 is supplied to the linear control electrodes $n_1$, $n_2$, –.

More specifically, in the second embodiment, the linear control electrodes n of the second control electrode means 50 which are driven depending on the display input signal are divided into sets of four. Each pair of linear control electrodes in the respective sets are driven in an order of, for example, $n_1$, $n_2$; $n_2$, $n_3$; $n_3$, $n_4$; and $n_4$, $n_1$. Drive voltage applied to the linear control electrodes n in the form of a staircase-like shape and divided into from lowermost first drive voltage to uppermost third drive voltage, so that electrons may be deflected depending on a balance of the drive voltage applied to each pair of adjacent linear control electrodes n. Each of the phosphor layers F are divided into three picture cells including each color phosphor layer elements R, G and B, so that the picture cells may be caused to emit light in a manner independent from one another. For example, it is supposed that drive voltage is simultaneously applied to the linear control electrodes $n_1$ and $n_2$ while the linear control electrodes $m_1$ and $m_2$ are being driven so that a region of the phosphor layer F surrounded by the linear control electrodes $m_1$, $m_2$, $n_1$ and $n_2$ may be caused to emit light. In this instance, when a voltage drop portion of drive voltage which corresponds to a latter half of a staircase is applied to the linear control electrode $n_1$ and a voltage rise portion of the drive voltage which corresponds to the first half of the staircase is applied to the linear control electrode $n_2$, comparison between the drive voltages applied to the linear control electrodes $n_1$ and $n_2$ indicates that the voltage of the control electrode $n_1$ is first larger than that of the electrode $n_2$, then becomes equal to the latter and is finally smaller than it. Thus, electrons travelling toward the anode are first deflected by the linear control electrode $n_1$, resulting in impinging on the phosphor layer element R of red luminous color and then the intermediate phosphor layer element G of green luminous color, and subsequently deflected by the linear control electrode $n_2$ to lead to impingement on the phosphor layer element B of blue luminous color. A decrease in drive voltage of any one of the two linear control electrodes to a low level or cut-off level fails to cause the picture cell therebetween to emit light.

As can be seen from the foregoing, in the illustrated embodiment, portions of a plurality of the phosphor layers F in a row which are interposed between a pair of the linear control electrodes m being scanned are divided into sets of four corresponding to the linear control electrodes n divided into sets of four for driving. Each set is driven while being divided into three picture cells for every color phosphor layer elements R, G and B. Accordingly, twelve picture cells laterally arranged constitute each set, and positionally corresponding picture cells in the respective sets are simultaneously driven. An order of driving of the so-formed picture cells is shown in FIG. 7.

The anode drive circuit 51 may be constructed in any manner. For example, supposing that the display input signal is a signal having bits equal in number to the linear control electrodes n and each of the bits is a signal indicating a driving state of each of the linear control electrodes n, the anode drive circuit 51 may be so constructed that it may take AND between each of output bits of a cycle a staircase-like signal generated from the function voltage generating circuit 52 and each bit of the display input signal corresponding thereto to supply a signal to the linear control electrodes n depending on a level of voltage of the function voltage generating circuit 52.

Figure 8:
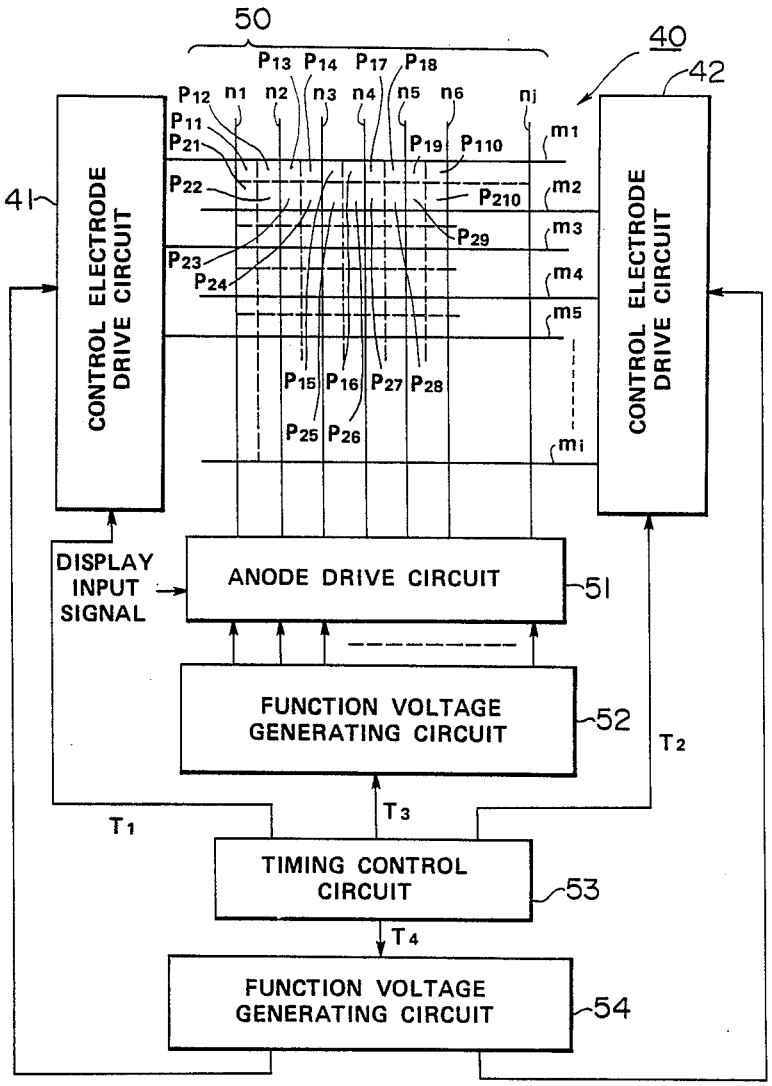
FIG. 8 is a schematic view showing a further embodiment of an image display device according to the present invention.

Now, a further embodiment of an image display device according to the present invention will be described with reference to FIGURE B. An image display device of the embodiment is a monochromatic type fluorescent display device which is constructed in such a manner that an anode is formed by a phosphor layer directly deposited on a whole surface of a substrate and a metal backing deposited on the phosphor layer so as to serve as a conductive layer, so that both first and second control electrode means may exhibit an electron deflecting function. In FIG. 8, reference numerals like in FIG. 5 designate corresponding parts. The image display device of the illustrated embodiment includes a second function voltage generating circuit 54, to which a timing pulse $T_4$ is supplied from a timing control circuit 53 to supply a staircase-like cycle signal to both control electrode drive circuits 41 and 42.

The remaining of the embodiment shown in FIG. 8 may be constructed in substantially the same manner as that of FIG. 5.

Now, the manner of operation of the image display device of the embodiment shown in FIG. 8 constructed as described above will be described mainly in connection with driving of both control electrode means 40 and 50 with reference to FIGS. 8 to 12.

Figure 9:
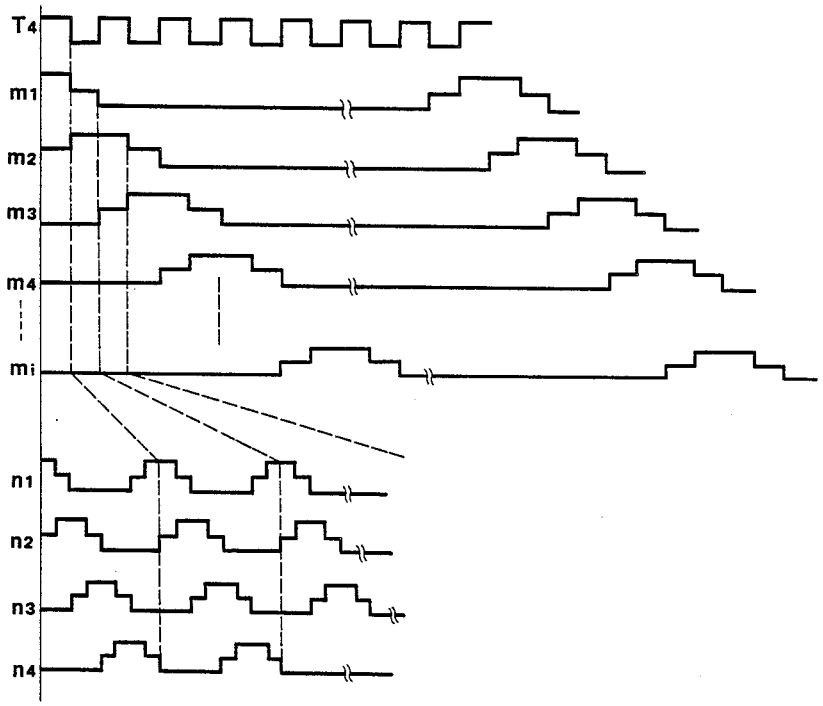
FIG. 9 is a timing chart showing an example of timing of drive in the embodiment of FIG. 8.
Figure 10:
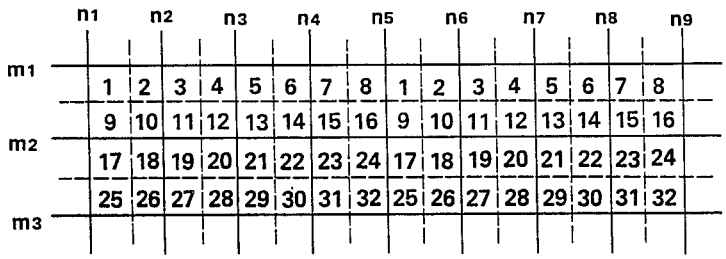
FIG. 10 is a view showing an order in which picture cells are driven in the embodiment of FIG. 8.

As shown in FIG. 9, linear control electrodes $n_1$, $n_2$, — of the second control electrode means 50 are driven in substantially the same manner as in the embodiment of FIG. 5. The linear control electrodes n are divided into sets of four. However, a staircase-like cycle signal which is supplied to the respective pairs of linear control electrodes n in the respective sets in turn while shifting contains two high levels comprising a first high level and a second high level, so that the embodiment may deflect electrons toward the control electrode means to which drive signal of a higher level is supplied.

Then, an output signal of the function voltage generating circuit 54 is supplied to a power connection terminal of each of the control electrode drive circuits 41 and 42. The control electrode drive circuits 41 and 42 each generate its output while shifting signals supplied to the power connection terminal in turn. The function voltage generating circuit 54 outputs a first high level signal in response to a high level signal of a pulse $T_4$ generated from the timing control circuit 53 and a second high level signal lower than the first high level signal in response to a low level signal of the pulse. In response to the first and second high level signals, the control electrode drive circuits 41 and 42 supply a signal to the first control electrode means 40. The low level signal (cut-off level signal) corresponds to a state that any signal is not supplied from the control electrode drive circuits 41 and 42 to the first control electrode means. Thus, as shown in FIG. 9, the staircase-like cycle signal comprising the first and second high level signals is supplied to the respective pairs of linear control electrodes m of the first control electrode means 40 in turn while shifting, accordingly, electrons which enter regions of phosphor layers interposed between or surrounded by a pair of the linear control electrodes m are deflected toward the control electrode means having the signal of a higher level supplied thereto.

Figures 11A, 11B, 11C:
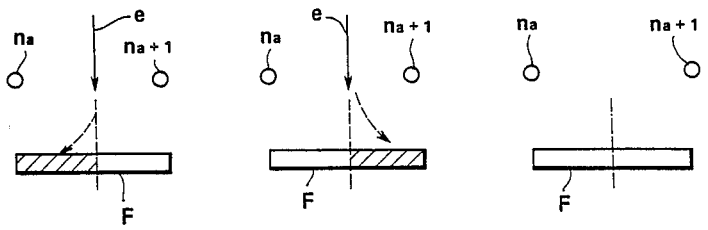
FIGS. 11(*a*), 11(*b*) and 11(*c*) each are a schematic view showing deflection and cut-off of an electron in the embodiment of FIG. 8.

Now, such deflection of electrons will be described with reference to FIG. 11. Supposing that, as shown in FIG. 11(*a*), the first high level signal is supplied to left one of a pair of linear control electrodes $n_a$ and $n_{a+1}$ and the second high level signal is supplied to the right control electrode while both linear control electrodes are being driven, an electron e entering between both control electrodes is attracted by the left control electrode $n_a$ to impinge on a left half of a phosphor layer F, resulting in the left half emitting light. On the contrary, as shown in FIG. 11(*b*), when the first and second high level signals are supplied to the right and left linear control electrodes $n_{a+1}$ and $n_a$, respectively, an electron e impinges on a right half of the phosphor layer F to cause it to emit light. Supply of the low level signal to at least one of the linear control electrodes $n_a$ and $n_{a+1}$ fails to cause the picture cell to emit light. This is also applicable to the embodiment shown in FIG. 5.

In the above description, the phosphor layer F is laterally divided into two by the second control electrode means 50 for luminous display. However, it is vertically divided into two by the first control electrode means 40 for scanning in FIG. 8.

Thus, in the illustrated embodiment, both first and second control electrode means 40 and 50 function to deflect electrons, so that drive of the respective sets of the linear control electrodes n of the second control electrode means 50 in synchronism with scanning and deflection operation of the first control electrode 40 causes regions of the phosphor layer defined by both control electrode means 40 and 50 to be divided into four picture cells P for luminous display. An order in which the respective picture cells P are selectively driven is as indicated at numerals in FIG. 10. First, picture cells $P_{11}$, $P_{19}$, –, $P_{1(4n+1)}$ are simultaneously selectively driven; then picture cells $P_{12}$, $P_{110}$, –, $P_{1(4n+2)}$ are simultaneously selectively driven, —, and finally picture cells $P_{18}$, –, $P_{1(4n+4)}$ are simultaneously selectively drive. Subsequently, picture cells indicated at $P_{2(4n+1)}$, — are simultaneously selectively driven in turn. Such selective driving are repeated in connection with the remaining picture cells.

Thus, the embodiment is constructed so as to causes both control electrode means 40 and 50 to exhibit an electron deflecting function and each region of the phosphor layer F defined by both control electrode means 40 and 50 to be divided into four picture cells, so that a display image may be provided with high resolution. Also, control of voltage applied to the control electrode means nearer the phosphor layer F facilitates adjustment of luminescence of the phosphor layer F, resulting in an image of high luminescence being displayed.

In each of the above-described embodiments, the second control electrode means 30 or 50 is driven depending on a display input signal. However, it may be so constructed that the first control electrode means 20 or 40 is driven depending on the display input signal and the second control electrode means 30 or 50 is be scanned.

In addition, voltage applied to the conductive layer of the anode formed on the substrate may be suitably selected within a range of hundreds of volts to tens of kilovolts. Likewise, voltage applied to each of the control electrode means 20, 30, 40 and 50 may be suitably selected within a range of tens of volts to hundreds of kilovolts.

Figure 12A:
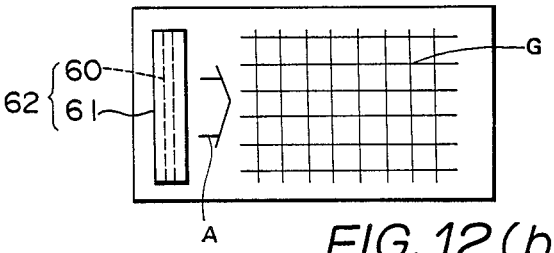
FIGS. 12(*a*) and 12(*b*) are a plan view and a front view showing an example of an electron source.
Figure 12B:
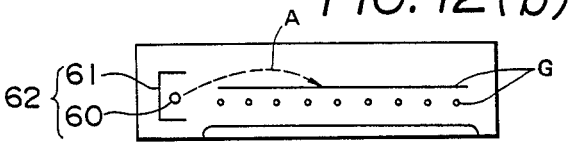
Figure 13:
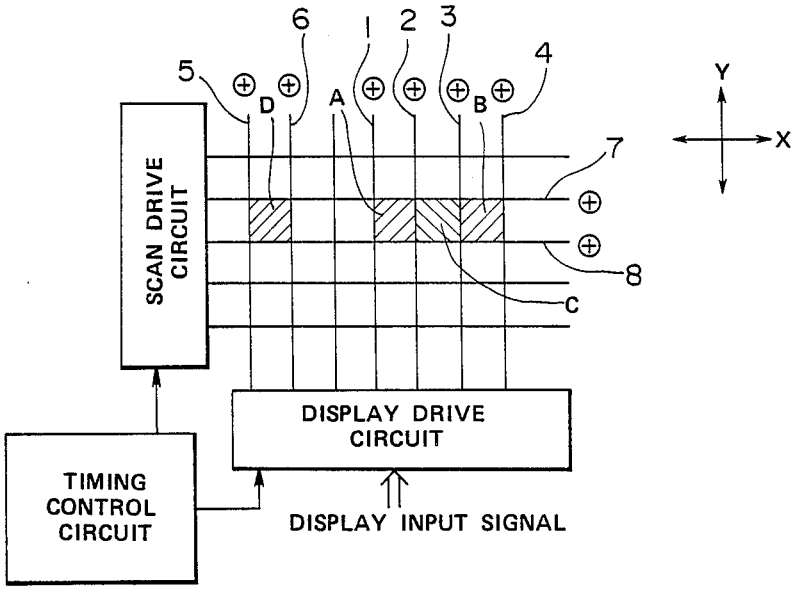
FIG. 13 PRIOR ART
FIG. 13 is a schematic view showing a conventional image display device.

Further, in each of the embodiments a plurality of filamentary cathodes stretched above the control electrode means are used as the electron source as in the prior art. However, it, as shown in FIG. 12, may be so constructed that an electron source 62 comprising filaments 60 and a reflection electrode 61 is provided at a side of a control electrode G arranged in matrix-like manner to supply electrons from the source 62 to the electrode G as indicated at an arrow A.

As can be seen from the foregoing, the image display device of the present invention is constructed in the manner that two control electrode means are arranged in directions across each other, wherein the respective pairs of control electrodes in one of the control electrode means are scanned in turn and the control electrodes of the other control electrode means are divided into sets of three or more, in which the respective pairs of control electrodes are driven in turn in synchronism with the scanning.

Accordingly, the present invention permits an interval between picture cells to be significantly decreased using control electrode means of a simple structure, to thereby provide a displayed image with high resolution.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by letters Patent of the U.S. is:

1. An image display device comprising:

a substrate;

an anode formed on said substrate, said anode including a conductive layer and a phosphor layer;

a first control electrode, said first control electrode including a first plurality of linear control electrodes arranged in parallel with one another above said anode;

a second control electrode, said second control electrode including a second plurality of linear control electrodes arranged in parallel with one another above said first control electrode in the direction perpendicular to said first control electrode;

an electron source arranged above said second control electrode for generating electrons therefrom;

a casing forming an envelope in cooperation with said substrate, said envelope receiving said anode, first and second control electrodes and electron source therein and being evacuated to a high vacuum;

a means for supplying positive voltage to said conductive layer of said anode;

a means for scanning in succession each adjacent two linear control electrodes of said first control electrode; and a means for driving each adjacent two linear control electrodes in each adjacent at least three linear control electrodes of said second control electrode in succession in synchronism with said scanning of said first control electrode in response to a display input signal.

2. The image display device as defined in claim 1, wherein said means for scanning includes a means responsive to said display input signal for causing each adjacent two linear control electrodes of said second control electrode to be scanned in succession and each adjacent two linear control electrodes in each adjacent at least three electrodes of said first control electrode to be driven in succession in synchronism with said scanning of said second control electrode.

3. The image display device as defined in claim 1, wherein said conductive layer is deposited on said substrate and said phosphor layer is deposited on said conductive layer.

4. The image display device as defined in claim 1, wherein said phosphor layer is deposited on said substrate and said conductive layer is deposited on said phosphor layer.

5. The image display device as defined in claim 1, wherein said anode is formed all over said substrate.

6. The image display device as defined in claim 1, wherein said anode is formed in a strip-like manner on said substrate.

7. The image display device as defined in claim 3, wherein said phosphor layer is deposited on said conductive layer in a dot-like manner.

8. The image display device as defined in claim 3, wherein said phosphor layer is deposited on said conductive layer in a strip-like manner.

9. An image display device comprising:

a substrate;

an anode formed on said substrate, said anode including a conductive layer and a phosphor layer;

a first control electrode, said first control electrode including a first plurality of linear control electrodes arranged in parallel with one another above said anode;

a second control electrode, said second control electrode including a second plurality of linear control electrodes arranged in parallel with one another above said first control electrode in the direction perpendicular to said first control electrode;

an electron source arranged above said second control electrode for generating electrons therefrom;

a casing forming an envelope in cooperation with said substrate, said envelope receiving said anode, first and second control electrodes and electron source therein and being evacuated to a high vacuum;

a function drive circuit connected to said second control electrode and being supplied with a display input signal;

a function voltage generating circuit connected to said function drive circuit, and function voltage generating circuit generating a staircase-like cycle signal for controlling said second control electrode;

a timing control circuit connected to said function voltage generating circuit, said timing control circuit generating a timing pulse;

control electrode drive circuits connected to said timing control circuit and each of said linear control electrodes of said first control electrode alternatively;

wherein said control electrode drive circuits drive each adjacent two linear control electrodes of said first control electrode in succession in a scanning operation in response to said timing pulse from said timing control circuit; and wherein said function drive circuit selectively supplies said staircase-like cycle signal from said function voltage generating circuit to said linear control electrodes of said second control electrode in response to said display input signal for driving each adjacent two linear control electrodes in each adjacent four linear control electrodes of said second control electrode.

10. The image display device as defined in claim 9, wherein said anode comprises a plurality of three strip-like phosphor layers each deposited in parallel with one another on said conductive layer exhibiting red, green and blue luminous colors, respectively.

11. The image display device as defined in claim 10, wherein said linear control electrodes of said second control electrode is arranged in parallel with said strip-like phosphor layer having each three strip-like phosphor layers interposed between each adjacent two control electrodes.

12. The image display device as defined in claim 9, further comprising a second function voltage generating circuit for supplying a staircase-like cycle signal to said control electrode drive circuits in response to said timing pulse from said timing control circuit, wherein said staircase-like cycle signal containing a first high level and a second high level signals supplied to said each adjacent two linear control electrodes of said second control electrode in succession deflects electrons toward said control electrode to which said high level signal is applied and wherein said staircase-like cycle signal containing a first high level and a second high level signals supplied to said each adjacent two linear control electrodes of said first control electrode deflects electrons entering into regions surrounded by said adjacent two linear control electrodes of said first control electrode toward said linear control electrode to which said high level signal is applied.

* * * * *